US006123019A

United States Patent [19]

Daniel

[11] Patent Number: 6,123,019

[45] Date of Patent: Sep. 26, 2000

[54] WET-TYPE FLYWHEEL BRAKE INTEGRATED INTO OIL FILM QUILL

[75] Inventor: Edward A. Daniel, Ft. Loramie, Ohio

[73] Assignee: The Minster Machine Company, Minster, Ohio

[21] Appl. No.: 09/305,429

[22] Filed: May 5, 1999

[51] Int. Cl.[7] ..... B30B 15/10; B30B 1/26

[52] U.S. Cl. ..... 100/282; 188/71.5; 192/18 A

[58] Field of Search ..... 100/280, 282; 188/71.5; 192/18 A

[56] References Cited

U.S. PATENT DOCUMENTS

| | | | |
|---|---|---|---|
| 3,614,999 | 10/1971 | Sommer . | |
| 3,696,898 | 10/1972 | Sommer . | |
| 3,713,517 | 1/1973 | Sommer . | |
| 3,835,971 | 9/1974 | Spanke et al. . | |
| 3,860,100 | 1/1975 | Spanke et al. . | |
| 3,946,840 | 3/1976 | Sommer . | |
| 4,050,557 | 9/1977 | Beneke et al. . | |
| 4,095,523 | 6/1978 | Drungil | 100/282 |
| 4,122,926 | 10/1978 | Spanke et al. . | |
| 4,135,611 | 1/1979 | Spanke . | |
| 4,183,425 | 1/1980 | Sommer . | |
| 4,186,827 | 2/1980 | Spanke . | |
| 4,194,606 | 3/1980 | Beneke . | |
| 4,432,443 | 2/1984 | Sommer . | |
| 4,440,278 | 4/1984 | Weber . | |
| 4,533,029 | 8/1985 | Weber . | |
| 4,562,907 | 1/1986 | Maeda . | |
| 4,589,533 | 5/1986 | Del Duca . | |
| 4,693,350 | 9/1987 | Sommer . | |
| 4,785,926 | 11/1988 | Matson . | |
| 5,190,129 | 3/1993 | Sommer . | |
| 5,194,057 | 3/1993 | Sommer . | |
| 5,487,456 | 1/1996 | Sommer . | |
| 5,564,333 | 10/1996 | Palmer . | |
| 5,657,843 | 8/1997 | Sommer . | |
| 5,697,862 | 12/1997 | Sommer . | |
| 5,769,187 | 6/1998 | Sommer | 188/71.5 |
| 5,921,361 | 7/1999 | Sommer | 192/18 A |
| 5,947,244 | 9/1999 | Sommer | 192/18 A |

*Primary Examiner*—Stephen F. Gerrity
*Attorney, Agent, or Firm*—Randall J. Knuth

[57] ABSTRACT

A wet-type flywheel brake system for use in a mechanical press includes a first and second brake assembly each installed within a respective brake housing space defined in a non-rotational quill. Each of the brake assemblies includes a brake lining element arranged in lateral facing relationship with the flywheel and an associated hydraulic seal-type piston that selectively moves the brake lining element into a friction-type braking engagement with the flywheel. The brake housing spaces are flooded with oil to immerse the brake lining elements. Oil for this purpose is provided from a flywheel bearing assembly integrated with the quill assembly and which is arranged for fluid communication with the quill-located brake housing spaces.

22 Claims, 5 Drawing Sheets

WET-TYPE FLYWHEEL BRAKE INTEGRATED INTO OIL FILM QUILL

BACKGROUND OF THE INVENTION

1. Field of the Invention

The present invention relates to a braking system for use with a flywheel of a mechanical press and, more particularly, to a wet-type flywheel brake assembly integrated into the quill assembly and which uses oil provided to the flywheel bushing assembly.

2. Description of the Related Art

Mechanical presses of the type performing industrial activity such as stamping and drawing operations have a conventional configuration including a frame structure with a crown and bed portion and a slide supported within the frame for reciprocating movement toward and away from the bed. A crankshaft rotatably disposed within the crown is arranged in driving connection with the slide using a connecting arm assembly. A flywheel assembly rotatably driven by a drive mechanism is selectively connectable with the crankshaft for driving rotation thereof, utilizing a clutch/brake combination to make the driving connection. These mechanical presses are used in a wide variety of workpiece operations employing a large selection of die sets, with the press machine varying substantially in size and available tonnage depending upon the intended use.

The primary source for stored mechanical energy in mechanical presses is the flywheel, which is conventionally located between the main drive motor and the clutch. The flywheel and its associated bearing are mounted on either the driveshaft, crankshaft, or the press frame by use of a quill. The main drive motor replenishes the energy lost from the flywheel during press stamping operations when the clutch couples the flywheel to the press driven parts. During engagement of the clutch, the flywheel drops in speed as the press driven parts are brought up to press running speed. The flywheel rotates in unison with the engaged clutch while the flywheel bearings have no relative rotation, except for the case of a quill arrangement whereby relative rotation is always present.

Prior art flywheel brakes are usually pneumatically-applied dry-friction brakes subject to considerable wear due to their design and must be serviced and replaced frequently. The flywheel brake is typically mounted in or on the press crown, so if it must be serviced, the press must be shut down while maintenance personnel gain access to and repair the flywheel brake and/or renew the linings. Press down time leads to lost production, adding to the expense of flywheel brake service. In addition, due to the many different flywheel and press structures, multiple costly flywheel brake mounting configurations are used.

SUMMARY OF THE INVENTION

One object of the present invention to reduce the necessity to replace flywheel brake linings, to considerably extend the time interval between lining replacements, and to simplify the attachment of such a flywheel brake to the press structure.

According to the present invention there is disclosed a wet-type flywheel brake system integrated into an oil film quill for use in a mechanical press. The brake system includes a first and second brake assembly each installably mounted within a respective brake housing space defined in a quill, which is non-rotationally connected to the press. Each of the brake assemblies preferably includes a flywheel engaging member in the form of a brake lining element that is arranged in facing relationship with the flywheel at a respective side thereof, and further includes an associated hydraulic piston member in the form of an annular seal. Activation of the hydraulic seal-type piston selectively moves the facing brake lining element into a friction-type braking engagement with the flywheel to effect the desired flywheel braking activity. The quill-located brake housing spaces are flooded with oil to fully immerse at least the brake lining elements and thereby develop the wet-type feature associated with the flywheel braking device. The action of the oil between the frictional surfaces prevents or reduces lining wear to an insignificant level, thus extending lining life indefinitely. The oil also removes the heat of engagement which is destructive to the lining and its contact surface. Oil is preferably communicated from the flywheel bearing assembly, which is preferably provided in the form of a hydrostatic bearing pad assembly integrally associated with the quill assembly and arranged for fluid communication with the brake housing spaces. Alternative bearings, for example, hydrodynamic bushings or tapered roller bearings could be used to support the flywheel and the oil coming off these bearing types could be used to flood the flywheel brake linings.

The invention, in one form thereof, relates to a mechanical press comprising, in combination, a frame structure with a crown and a bed; a slide guided by the frame structure for reciprocating movement in opposed relation to the bed; a drive mechanism attached to the frame structure; a quill assembly having a quill non-rotationally connected to the press; a flywheel assembly rotatably driven by the drive mechanism, the flywheel assembly including a flywheel rotatable relative to the frame structure and axially mounted to the quill; a crankshaft rotatably disposed within the crown and in driving connection with the slide, the crankshaft selectively connectable with the flywheel for driving rotation thereby; the quill including a first recess formed therein and disposed adjacent the flywheel at one side thereof, the first quill recess defining a first chamber; the quill further including a second recess formed therein and disposed adjacent the flywheel at another side thereof, the second quill recess defining a second chamber; and a brake system operatively associated with the flywheel. The brake system comprises, in combination, a first brake assembly, which is disposed at least in part within the first quill recess, for selectively applying a braking action to the flywheel; and a second brake assembly, which is disposed at least in part within the second quill recess, for selectively applying a braking action to the flywheel.

Each one of the first and second brake assemblies, in one form thereof, further comprises a respective flywheel engaging member arranged in facing relationship with the flywheel at the respective side thereof; and an associated hydraulic piston means for selectively reversibly moving the flywheel engaging member into braking engagement with the flywheel in response to the hydraulic activation thereof. A means is provided for supplying fluid to at least one of the first quill recess and the second quill recess to enable hydraulic contact with at least the flywheel engaging member associated therewith.

The mechanical press, in another form thereof, further comprises a flywheel bearing supporting the flywheel assembly, the flywheel bearing including at least one bearing assembly disposed between the quill and the flywheel. The at least one bearing assembly comprises a hydrostatic bearing pad means that is arranged, at least in part, for fluid communication with each one of the first quill recess and the second quill recess to enable hydraulic contact (e.g., immersion) with the flywheel engaging member associated therewith. There is included a means to provide pressurized fluid to the hydrostatic bearing pad means. The hydrostatic bearing pad means comprise, in one form thereof, a plurality of hydrostatic bearing pads formed in the quill and disposed in opposing facing relationship to a bushing connected to the flywheel and annularly disposed about the quill. A clearance space defined between the plurality of hydrostatic bearing pads and the bushing is arranged for fluid communication with each one of the first quill recess and the second quill recess.

The mechanical press, in another form thereof, further comprises a pump for supplying a pressurized fluid flow and a fluid channel formed in the quill and adapted for coupling to the pump, the fluid channel being arranged at one section thereof for fluid communication with the first quill recess and being arranged at another section thereof for fluid communication with the second quill recess. The hydraulic piston means associated with each of the first and second brake assemblies further includes, in one form thereof, an annular seal member. The annular seal member defines with the quill an associated hydraulic pressurization chamber arranged for fluid communication with the pump via the fluid channel.

The invention, in another form thereof, is directed to a mechanical press comprising, in combination, a frame structure with a crown and a bed; a slide guided by the frame structure for reciprocating movement in opposed relation to the bed; a drive mechanism attached to the frame structure; a quill assembly having a quill non-rotationally connected to the press; a flywheel assembly rotatably driven by the drive mechanism, the flywheel assembly including a flywheel rotatable relative to the frame structure and axially mounted to the quill; a crankshaft rotatably disposed within the crown and in driving connection with the slide, the crankshaft selectively connectable with the flywheel for driving rotation thereby; the quill including a first recess formed therein and disposed adjacent the flywheel at one side thereof, the first quill recess defining a first chamber; the quill further including a second recess formed therein and disposed adjacent the flywheel at another side thereof, the second quill recess defining a second chamber; and a brake assembly for selectively applying a braking action to the flywheel. The brake assembly comprises, in combination, a first braking arrangement disposed at least in part within the first quill recess and a second braking arrangement disposed at least in part within the second quill recess. Each of the first and second braking arrangements comprises, in combination, a respective flywheel engaging member arranged in facing relationship with the flywheel at the respective side thereof and an associated hydraulic piston means for selectively reversibly moving the associated flywheel engaging member into braking engagement with the flywheel in response to the hydraulic activation thereof. A means is provided to supply fluid to at least one of the first quill recess and the second quill recess to enable hydraulic contact with the flywheel engaging member associated therewith.

The fluid supply means further comprises, in one form thereof, at least one bearing assembly disposed between the quill and the flywheel, the at least one bearing assembly comprising a hydrostatic bearing pad means arranged, at least in part, for fluid communication with each one of the first quill recess and the second quill recess; and a means for providing pressurized fluid to the hydrostatic bearing pad means. The hydrostatic bearing pad means includes, in one form thereof, a plurality of hydrostatic bearing pads formed in the quill and disposed in opposing facing relationship to a bushing connected to the flywheel and annularly disposed about the quill; wherein a clearance space defined between the plurality of hydrostatic bearing pads and the bushing is arranged for fluid communication with each one of the first quill recess and the second quill recess.

The mechanical press further includes, in one form thereof, a first means for providing pressurized hydraulic fluid to the respective hydraulic piston means associated with at least one of the first braking arrangement and the second braking arrangement. The first means further includes a pump for supplying a pressurized fluid flow; and a fluid channel formed in the quill and adapted for coupling to the pump, the fluid channel being arranged at one section thereof for fluid communication with the first quill recess and being arranged at another section thereof for fluid communication with the second quill recess. Each respective hydraulic piston means preferably includes an annular seal member that defines with the quill an associated pressurization chamber arranged for fluid communication with the pump via the fluid channel.

The invention, in another form thereof, relates to an assembly for use with a flywheel assembly of a press machine, the flywheel assembly including a flywheel rotatable relative to a frame structure of the press machine. The assembly comprises, in combination, a housing means for defining at least one brake housing space adjacent the flywheel at a respective side thereof; and a respective brake assembly disposed, at least in part, within each one of the at least one brake housing space defined by the housing means and being operative to selectively apply a braking action to the flywheel at the respective side thereof.

The assembly further comprises, in one form thereof, a means for providing fluid to each one of the at least one brake housing space defined by the housing means to enable hydraulic contact with the respective brake assembly disposed therein.

The assembly further includes, in another form thereof, a flywheel bearing assembly for supporting the flywheel, the flywheel bearing assembly comprising a hydrostatic bearing pad means arranged, at least in part, for fluid communication with each one of the at least one brake housing space defined by the housing means to enable hydraulic contact with the respective brake assembly disposed therein. Each one of the brake assemblies further includes, in one form thereof, a respective flywheel engagement means for making a selectively actuatable frictional connection with the flywheel at the respective side thereof; and an associated motion actuator means for selectively reversibly actuating the flywheel engagement means into making the frictional connection with the flywheel. The flywheel engagement means further includes a flywheel engaging member arranged in facing relationship with the flywheel at the respective side thereof, and the motion actuator means associated therewith further includes a respective hydraulic piston means for selectively reversibly moving the flywheel engaging member into braking engagement with the flywheel in response to the hydraulic activation thereof. The hydraulic piston means is preferably an annular seal member.

The housing means further comprises, in one form thereof, a quill assembly including a quill non-rotationally connected to the press machine, the flywheel being axially mounted to the quill. The quill includes a first recess formed therein and disposed adjacent the flywheel at one side thereof, the first quill recess having disposed therein a respective one of the brake assemblies. The quill further includes a second recess formed therein and disposed adjacent the flywheel at another side thereof, the second quill recess having disposed therein a respective another of the brake assemblies. A means is provided for supplying fluid to at least one of the first quill recess and the second quill recess to enable hydraulic contact with the respective brake assembly disposed therein.

The invention, in yet another form thereof, is directed to a system for use with a flywheel assembly of a press machine, the press machine including a quill assembly having a quill non-rotationally connected to the press machine, the flywheel assembly including a flywheel rotatable relative to a frame structure of the press machine and axially mounted to the quill. The system comprises, in combination, a first brake assembly disposed at least in part within a first brake housing space defined in the quill, the first brake housing space being disposed adjacent the flywheel at one side thereof, for selectively applying a braking action to the flywheel; and a second brake assembly disposed at least in part within a second brake housing space defined in the quill, the second brake housing space being disposed adjacent the flywheel at another side thereof, for selectively applying a braking action to the flywheel. The first brake assembly comprises, in combination, a respective flywheel engaging member arranged in facing relationship with the flywheel at the one side thereof, and an associated hydraulic piston means for selectively reversibly moving the flywheel engaging member into braking engagement with the flywheel in response to the hydraulic activation thereof. The second brake assembly comprises, in combination, a respective flywheel engaging member arranged in facing relationship with the flywheel at the another side thereof, and an associated hydraulic piston means for selectively reversibly moving the flywheel engaging member into braking engagement with the flywheel in response to the hydraulic activation thereof.

The system, in one form thereof, further includes a means for supplying fluid to the first brake housing space and the second brake housing space to enable hydraulic contact with the respective flywheel engaging member associated therewith.

The system, in another form thereof, further includes a flywheel bearing supporting the flywheel assembly, the flywheel bearing including at least one bearing assembly disposed between the quill and the flywheel; the at least one bearing assembly comprising a hydrostatic bearing pad means arranged, at least in part, for fluid communication with each one of the first brake housing space and the second brake housing space to enable hydraulic contact with the flywheel engaging member associated therewith. There is included a means for providing pressurized fluid to the hydrostatic bearing pad means.

The hydrostatic bearing pad means, in one form thereof, further include a plurality of hydrostatic bearing pads formed in the quill and disposed in opposing facing relationship to a bushing connected to the flywheel and annularly disposed about the quill. A clearance space defined between the plurality of hydrostatic bearing pads and the bushing is arranged for fluid communication with each one of the first brake housing space and the second brake housing space.

The system further includes a first means for providing pressurized hydraulic fluid to the respective hydraulic piston means associated with each one of the first brake assembly and the second brake assembly. The first means further comprises a pump for supplying a pressurized fluid flow; and a fluid channel formed in the quill and adapted for coupling to the pump, the fluid channel being arranged at one section thereof for fluid communication with the first brake housing space and being arranged at another section thereof for fluid communication with the second brake housing space. Each respective hydraulic piston means further includes an annular seal member that defines with the quill and thrust retainer an associated hydraulic pressurization chamber arranged for fluid communication with the pump via the fluid channel.

An advantage of the present invention is that the flywheel brake assembly may be incorporated into a brake housing area defined in the quill assembly and flooded with fluid to provide a wet-type brake lining.

Another advantage of the present invention is that retrieving oil from the flywheel bearing assembly for use by the brake linings takes advantage of existing components and requires the addition of no significant parts.

A further advantage of the invention is that for an embodiment in which hydrostatic/hydrodynamic bearing pads formed in the quill are used, the existing oil film clearance that is defined between the bearing pads and the surrounding flywheel bushing may be the route by which oil supplied to the bearing pads can reach the brake linings in the brake housing areas.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
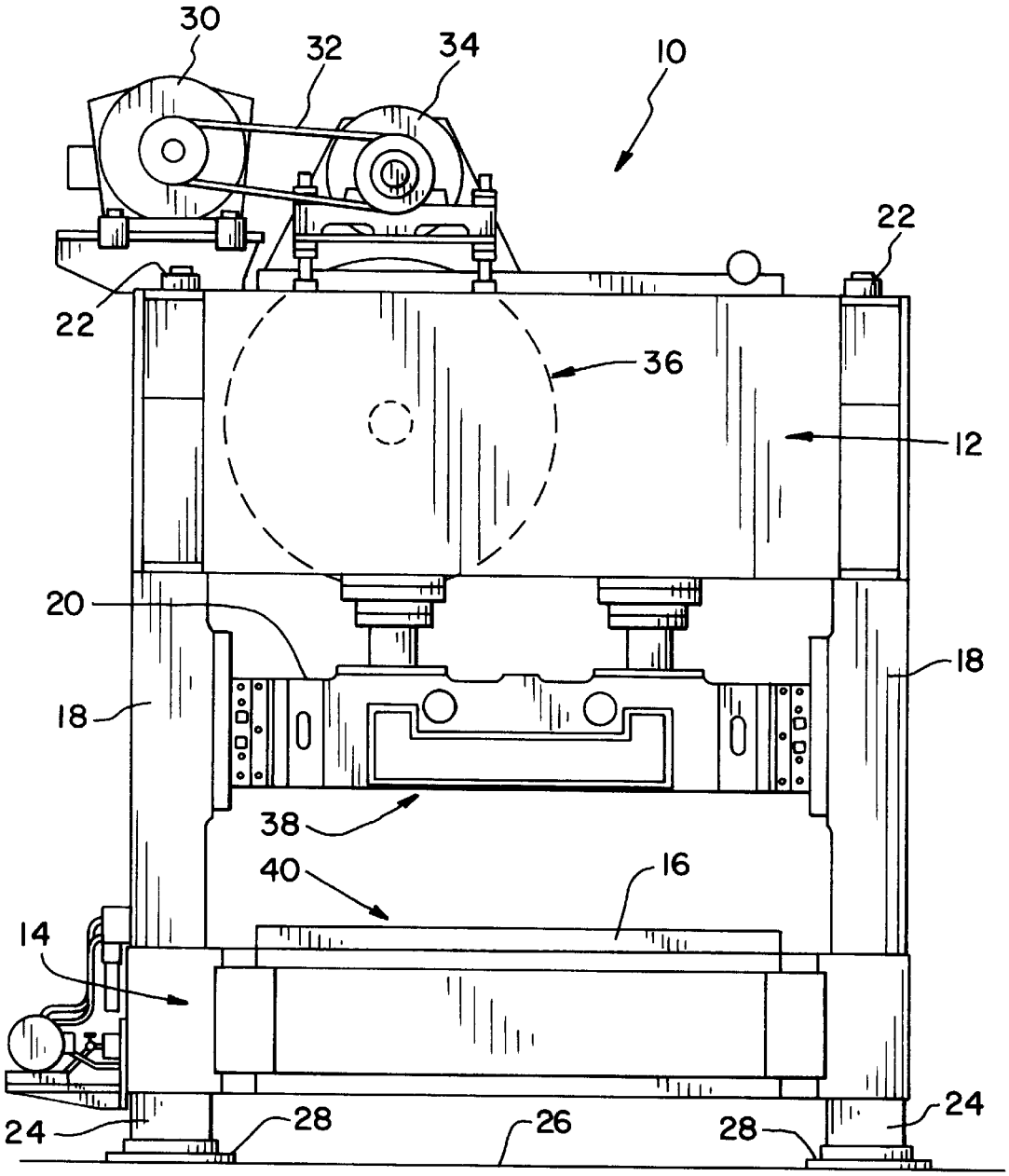
FIG. 1 is a front elevational view of a press machine in one illustrative form thereof incorporating the wet-type flywheel brake system of the present invention.

The wet-type flywheel brake system of the present invention may be installed within machines of the mechanical press type. Accordingly, reference is first made by way of background to FIG. 1, in which there is shown a mechanical press 10 of conventional form including a crown portion 12, a bed portion 14 having a bolster assembly 16 connected thereto, and uprights 18 connecting crown portion 12 with bed portion 14. Uprights 18 are connected to or integral with the underside of crown 12 and the upper side of bed 14. A slide 20 is positioned between uprights 18 for controlled reciprocating movement between crown 12 and bed 14. Tie rods (not shown), which extend through crown 12, uprights 18 and bed portion 14, are attached at each end with tie rod nuts 22. Leg members 24 are formed as an extension of bed 14 and are generally mounted on shop floor 26 by means of shock absorbing pads 28. A drive press motor 30, which is part of the drive mechanism, is attached by means of a belt 32 to an auxiliary flywheel 34 attached to crown 12. Auxiliary flywheel 34 is connected by means of a belt (not shown) to the main flywheel of the combination clutch/brake assembly, depicted generally at 36. This form of the press machine is described for illustrative purposes only as it should be apparent to those skilled in the art that the principles of the present invention may be practiced with, and incorporated into, other machine configurations. Press machine 10, when fully configured with a die assembly installed therein, further includes an upper die (not shown) generally located at area 38 and attached by known means in a conventional manner to the lower end of slide 20. A lower die (not shown) located generally at area 40 is attached by known means in a conventional manner to the upper end of bolster 16. The upper and lower dies, as so arranged in their opposing spaced-apart relationship, cooperate in a known manner during press operation to process a workpiece disposed therebetween, e.g., fastened to the lower die. The upper and lower dies together constitute a die set or assembly.

Figure 2:
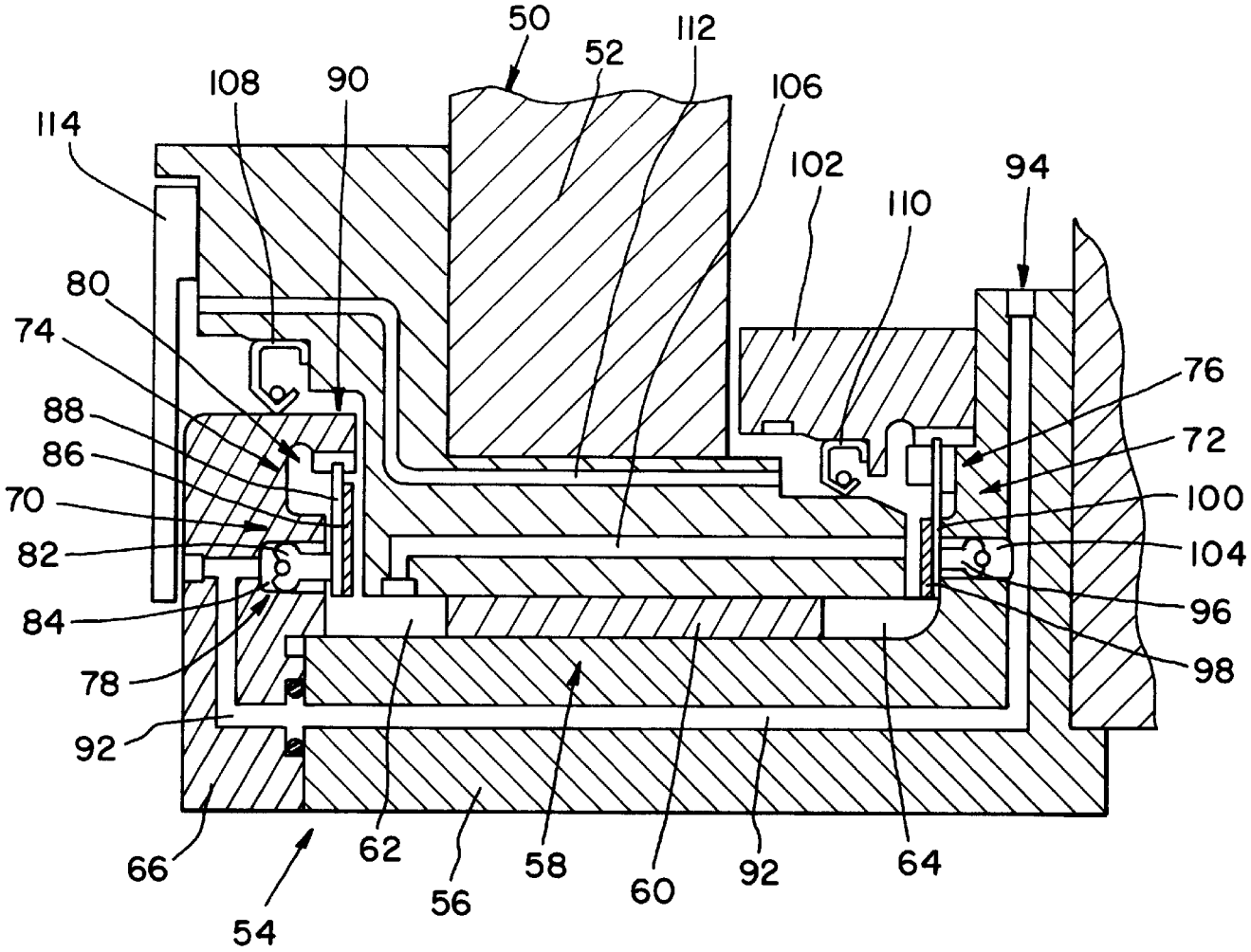
FIG. 2 is a fragmentary lateral cross-sectional view of an illustrative wet-type flywheel brake system according to one embodiment of the present invention.

Referring now to FIG. 2, there is shown in fragmented view a lateral cross-section of a press machine of the type shown in FIG. 1 to illustrate the integration of the wet-type flywheel brake system with the flywheel assembly, according to one embodiment of the present invention. FIG. 2 illustrates in conventional form a flywheel assembly including a flywheel 50 with hub portion 52 rotatable about a quill assembly generally illustrated at 54 and comprising a quill 56 non-rotationally connected to the press machine, for example. Flywheel 50 is therefore rotatably supported by fixedly secured quill 56. A crankshaft (not shown) rotates within quill 56 and is selectively connectable with flywheel 50 via a combination clutch/brake assembly of conventional form. A flywheel bearing assembly generally illustrated at 58 is preferably disposed between the rotatable flywheel assembly and the non-rotational quill assembly 54 to provide bearing support to flywheel 50. The illustrated bearing assembly 58 includes, in one form, an annular bearing bushing 60 connected to flywheel 50 and interposed between flywheel hub 52 and quill 56, and further includes an arrangement of hydrostatic/hydrodynamic bearing pads of the type disclosed in U.S. Pat. No. 5,556,207, which is assigned to the same assignee as the instant application and is hereby incorporated by reference herein. The bearing pads, in one form (not shown), are defined in a radially outward surface of quill 56 and open towards an inner bearing surface of flywheel bearing bushing 60. Pressurized fluid is supplied to the hydrostatic bearing pads to generate a lubricating oil film between the quill and flywheel bushing that assists in providing bearing support to the flywheel. A hydrodynamic effect is developed as relative rotation occurs between the rotating flywheel bushing and the non-rotating quill. The illustrated quill assembly 54 further includes a thrust retainer 66 integrally attached to quill 56 and arranged in a conventional manner at the outboard side of flywheel 50 to inhibit axial movement of flywheel 50. This configuration of press machine components is provided for illustrative purposes only and should not be considered in limitation of the present invention as it should be apparent to those skilled in the art that the wet-type flywheel brake system of the present invention can be integrated into various other such configurations and press machine types within the scope of the present invention.

Referring more particularly to FIG. 2, the wet-type flywheel brake system according to the present invention comprises a first brake assembly generally illustrated at 70 and a second brake assembly generally illustrated at 72 each disposed adjacent flywheel 50 at a respective side thereof and mounted within a respective brake housing area defined within quill assembly 54. A first brake housing area shown generally at 74 is provided in the form of a recess formed in quill assembly 54 (i.e., thrust retainer 66) and preferably extends annularly about an axis of rotation associated with the press machine. The illustrated first brake housing area 74 has an opening that is preferably arranged in immediately adjacent relationship with an outboard side of flywheel 50 and in facing opposition therewith. Likewise, a second brake housing area shown generally at 76 is provided in the form of a recess formed in quill assembly 54 (i.e., quill 56) and preferably extends annularly about the axis of rotation associated with the press machine. The illustrated second brake housing area 76 has an opening that is preferably arranged in immediately adjacent relationship with an inboard side of flywheel 50 and in facing opposition therewith. These brake housing areas 74 and 76 are provided in a form that allows a substantial sealing thereof so that fluid admitted therein may be substantially contained therein. A drain (not shown) drains oil off to the press sump from brake housing area 76.

Figure 3:
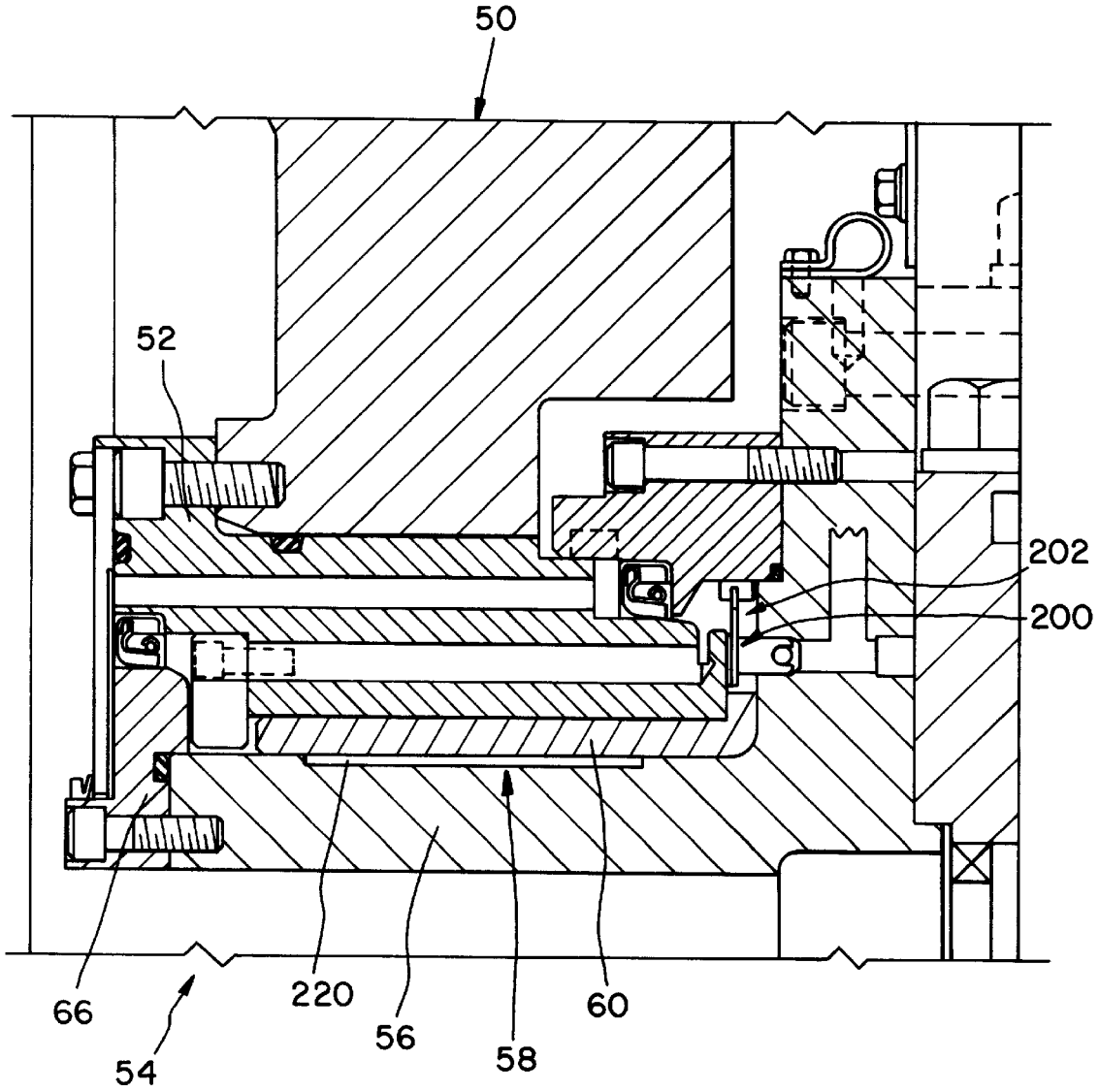
FIG. 3 is a fragmentary lateral cross-sectional view of an illustrative wet-type flywheel brake system according to one embodiment of the present invention.

FIG. 3 illustrates another embodiment of the present invention. FIG. 3 illustrates in fragmented view a lateral cross-section of a press machine of the type shown in FIG. 1 to illustrate the integration of the wet-type flywheel brake system with the flywheel assembly, according to one embodiment of the present invention. FIG. 3 illustrates in conventional form a flywheel assembly including a flywheel 50 with hub portion 52 rotatable about a quill assembly generally illustrated at 54 and comprising a quill 56 non-rotationally connected to the press machine, for example. Flywheel 50 is therefore rotatably supported by fixedly secured quill 56. A crankshaft (not shown) rotates within quill 56 and is selectively connectable with flywheel 50 via a combination clutch/brake assembly of conventional form. A flywheel bearing assembly generally illustrated at 58 is preferably disposed between the rotatable flywheel assembly and the non-rotational quill assembly 54 to provide bearing support to flywheel 50. The illustrated bearing assembly 58 includes, in one form, an annular bearing bushing 60 connected to flywheel 50 and interposed between flywheel hub 52 and quill 56, and may include an arrangement of hydrostatic/hydrodynamic bearing pads 220 of the type disclosed in U.S. Pat. No. 5,556,207, which is assigned to the same assignee as the instant application and is hereby incorporated by reference herein. The bearing pads, in one form, may be defined in a radially outward surface of quill 56 and open towards an inner bearing surface of flywheel bearing bushing 60. Pressurized fluid is supplied to the hydrostatic bearing pads to generate a lubricating oil film between the quill and flywheel bushing that assists in providing bearing support to the flywheel. A hydrodynamic effect is developed as relative rotation occurs between the rotating flywheel bushing and the non-rotating quill. The illustrated quill assembly 54 further includes a thrust retainer 66 integrally attached to quill 56 and arranged in a conventional manner at the outboard side of flywheel 50 to inhibit axial movement of flywheel 50. This configuration of press machine components is provided for illustrative purposes only and should not be considered in limitation of the present invention as it should be apparent to those skilled in the art that the wet-type flywheel brake system of the present invention can be integrated into various other such configurations and press machine types within the scope of the present invention.

FIG. 3 illustrates an embodiment of the present invention wherein the wet-type flywheel brake system comprises a single brake assembly generally illustrated at 200 and disposed adjacent flywheel 50 at a side thereof and mounted within a single brake housing area 202 defined within quill assembly 54. The single brake housing area shown generally at 202 is provided in the form of a recess formed in quill assembly 54 (i.e., quill 56) and preferably extends annularly about an axis of rotation associated with the press machine. The illustrated single brake housing area 202 has an opening that is preferably arranged in immediately adjacent relationship with a side of flywheel 50 and in facing opposition therewith. The single brake housing area 202 is provided in a form that allows a substantial sealing thereof so that fluid admitted therein may be substantially contained therein. A drain (not shown) drains oil off to the press sump from brake housing area 76.

Referring to FIG. 2, the illustrated first and second brake assemblies 70 and 72 are respectively mounted within first brake housing area 74 and second brake housing area 76 in accordance with one aspect of the present invention. Referring to FIG. 3, single brake assembly 200 is mounted within single brake housing 202. As will be discussed below in further detail, each of the brake assemblies 70, 72 and 200 is preferably provided in the form of a hydraulically-activatable braking device that operates to selectively apply a braking action to flywheel 50 by developing a frictional contacting engagement with a respective surface of flywheel 50. For this purpose, each of the brake assemblies 70, 72 and 200 is provided with a flywheel engaging member in the form of a conventional wet-type brake lining element that is selectively movable into engagement with flywheel 50 utilizing a hydraulic motion actuator preferably provided in the form of a piston-type device. However, this particular arrangement of braking components is provided for illustrative purposes only and should not be considered in limitation of the present invention as it should be apparent that the functions relating to the application of a braking influence and the actuation of such braking engagement may be implemented by other arrangements within the scope of the present invention.

Figure 4:
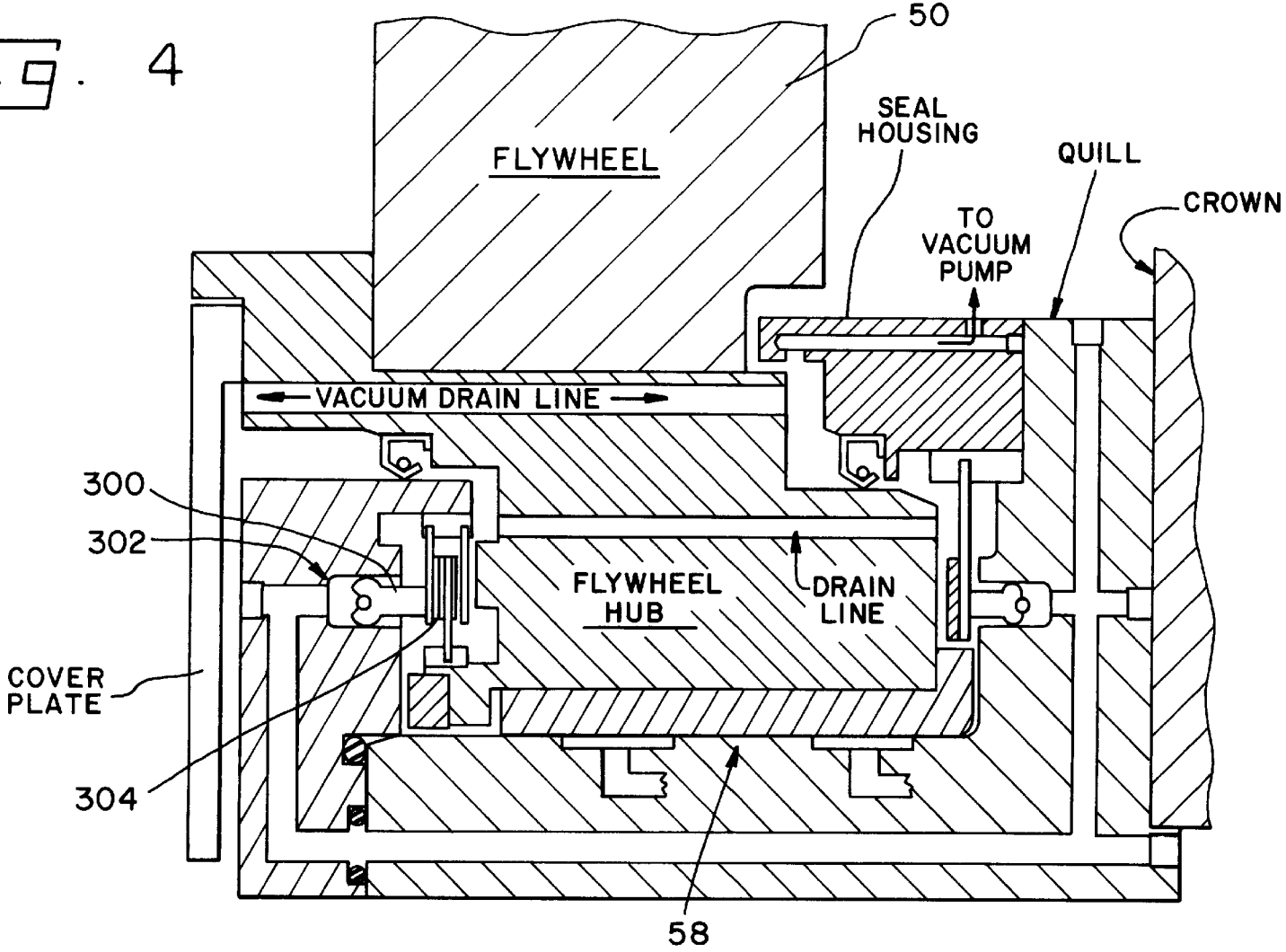
FIG. 4 is a fragmentary lateral cross-sectional view of an illustrative wet-type flywheel brake system according to one embodiment of the present invention.

FIG. 4 illustrates another embodiment of the present invention wherein multiple disk brake assembly 300 is mounted within multiple discs brake housing area 302 in accordance with one aspect of the present invention. Multiple disc brake assembly 302 is preferably provided in the form of a hydraulically-activatable braking device that operates to selectively apply a braking action to flywheel 50. For this purpose, brake assembly 302 is provided with a flywheel engaging member in the form of a multiple disk brake lining element 304 that is selectively moveable into engagement with flywheel 50 utilizing a hydraulic motion actuator preferably provided in the form of a piston-type device.

In accordance with another aspect of the present invention discussed below in further detail, brake housing areas 74, 76, 202 and 300 is preferably arranged to allow hydraulic fluid to be admitted therein for the purposes of enabling a hydraulic contact to develop with at least the brake lining element. For purposes herein, the enablement of a hydraulic contact should be considered as encompassing any form of contact by, interaction with, or exposure to hydraulic fluid that is experienced by at least the brake lining element, regardless of the duration of contact (i.e., not limited to a transient or continuous exposure to hydraulic fluid). For example, enabling such hydraulic contact includes, but is not limited to, creating a partial immersion of the brake lining element or associated brake assembly, creating a total immersion of the brake lining element or associated brake assembly (i.e., filling the entire brake housing area associated therewith to the extent possible), creating a variable fluid flow (at various flooding levels) through the associated brake housing area, and creating a rapid fluid flow (at various flooding levels) through the associated brake housing area to maintain an efficient cooling operation. Additionally, this wet-type feature for the flywheel brake assembly may be controlled and is preferably maintained to be continuously active, particularly during flywheel braking activity.

In accordance with another aspect of the present invention, the hydraulic fluid that is admitted into the brake housing areas 74, 76, 202 and 300 is communicated from the flywheel bearing assembly 58. For this purpose, adaptations/modifications may be made to ensure that a path of fluid communication exists between the bearing arrangement and the brake housing areas. However, this mode and manner of obtaining oil from the neighboring flywheel bearing assembly 58 should not be considered in limitation of the present invention as it should be apparent that other means may be used to provide fluid to the brake assemblies 70 and 72 mounted respectively in brake housing areas 74 and 76.

Referring to FIG. 2, and specifically to the illustrated first brake assembly 70 disposed at the outboard side of flywheel 50 within first brake housing area 74, the illustrated first brake housing area 74 includes an annular-shaped piston chamber illustrated at 78 and which extends generally in the axial direction, and further includes an annular-shaped brake chamber illustrated at 80 and which extends generally in the radial direction. First brake assembly 70 comprises, in one form thereof, a piston device provided in the form of an annular-shaped seal member 82 that is disposed within piston chamber 78 and which is operatively reversibly axially movable in response to the pressure condition of a hydraulic pressurization region 84 defined between seal-type piston 82 and thrust retainer 66. First brake assembly 70 further comprises a brake device provided in the form of a facing brake element or lining 86 attached to a brake backing or support plate 88 that, in combination, is integrally disposed within brake chamber 80 at a forward end thereof adjacent the opening of the associated first brake housing area 74 so as to be arranged in opposed facing relationship to a side surface of flywheel hub 52. The combination brake lining 86 and brake plate 88 is reversibly axially displaceable into a selective one of engagement and non-engagement with flywheel hub 52 at brake lining 86, as controlled by the actuating function of seal-type piston 82. The illustrated form and structure of first brake housing area 74, and particularly piston chamber 78 and brake chamber 80, should not be considered in limitation of the present invention as it should be apparent that various other designs are possible consistent with their ability to accommodate the placement therein of the selected brake assembly components. For example, the quill recess areas and seal-type pistons are preferably annular but may be fragmented or provided in other shapes and arrangements.

The illustrated brake lining 86 may be provided in the form of a single annular-shaped piece or alternately as a plurality of discrete brake lining segments arranged in a ring-type configuration about brake plate 88. The illustrated brake plate 88 is coupled at its radially outer end to a flange portion 90 of thrust retainer 66 in any conventional manner that accommodates axial movement of the integral brake plate 88 and brake lining 86. For example, brake plate 88 may be provided at its outer periphery with an arrangement of teeth that meshingly engage with a complementary arrangement of teeth provided at an inner periphery of thrust retainer flange portion 90. Brake plate 88 and brake lining 86 may be structured and dimensioned so as to optimize their frictional capabilities with a view towards optimally minimizing the time of frictional engagement needed to stop flywheel 50. Another related consideration involves proper management of the hydraulic pressurizing force that actuates the brake clamping condition, with a typical pressure level of 1000 psi for stopping flywheel rotation in a few seconds.

Briefly, in operation, piston pressurization region 84 is sufficiently pressurized by hydraulic fluid admitted therein via fluid supply line 92 illustratively formed in both quill 56 and thrust retainer 66 in the manner shown. A source of pressurized fluid (not shown) is coupled to fluid supply line 92 at its inlet end 94. This pressurization firstly induces seal-type piston 82 into actuating engagement with brake plate 88 (if these components are non-actuatively spaced-apart) and then causes the integral brake plate 88 and brake lining 86 to move axially inwardly in a sufficient manner towards flywheel 50 such that brake lining 86 comes into frictional surface-to-surface contacting engagement or connection with flywheel hub 52 to thereby effect a braking action. This braking action may be removed by evacuating hydraulic fluid from pressurization region 84, thereby axially withdrawing piston 82 from its brake-actuating position and causing the integral brake plate 88 and brake lining 86 to become similarly non-engaged with respect to flywheel 50. There may be provided some form of biasing device or return mechanism that forces the integral brake plate 88 and brake lining 86 back into their original positions of non-engagement with respect to flywheel 50 when the brake-activating influence provided by seal-type piston 82 is removed via de-pressurization of pressurization region 84. In their non-actuated state, piston 82 and the integral brake plate 88 and brake lining 86 are preferably arranged in spaced-apart relationship sufficient to be closed out via activation of piston device 82. Alternatively, piston 82 may be coupled to the integral brake lining 86 and brake plate 88 such that any movements of piston 82 produce corresponding displacements of integral brake lining 86 and brake plate 88.

Referring now to the illustrated second brake assembly 72 disposed at the inboard side of flywheel 50 within second brake housing area 76, quill 56 is preferably modified from its conventional form to have defined therein the illustrated second brake housing area 76 that is formed in a manner similar to first brake housing area 74 because it houses a similar arrangement of components as first brake assembly 70. More specifically, the illustrated second brake assembly 72 includes, in combination, a seal-type piston 96 and an integral brake lining 98 and brake plate 100 that is formed and arranged within its respective second brake housing area 76 in a manner and configuration respectively similar to piston 82, brake lining 86, and brake plate 88 of first brake assembly 70. Accordingly, for purposes of brevity, the discussion above pertaining to the general configuration and operation of first brake assembly 70 is applicable in its essential aspects to an understanding of second brake assembly 72. The illustrated second brake housing area 76 is preferably defined at its upper end by a seal housing 102 that is integrally attached to quill 56 and which forms part of quill assembly 54. Seal housing 102 is preferably provided with an arrangement of inner-facing teeth at an edge portion thereof for coupled meshing engagement with a complementary arrangement of teeth provided at a peripheral edge of brake plate 100.

Briefly, in operation, pressurization region 104 defined adjacent seal-type piston 96 of second brake assembly 72 is sufficiently hydraulically pressurized via fluid supply line 92, which is adapted for fluid communication with pressurization region 104. Accordingly, the set of piston pressurization regions 84 and 104 associated respectively with the outboard and inboard flywheel brake assemblies 70 and 72 can be simultaneously pressurized to effect a coordinated and stable braking action taking place at both sides of flywheel 50. Adequate pressurization of pressurization region 104 will cause seal-type piston 96 to be brought into engagement with brake plate 100 at a backside thereof, which actuates movement of the integral brake lining 98 and brake plate 100 towards flywheel hub 52 until braking engagement is achieved between brake lining 98 and an opposing contact surface of flywheel hub 52.

In accordance with a preferred aspect of the present invention aimed at making each of the brake assemblies 70 and 72 a wet-type braking apparatus, each one of the combination brake lining 86/brake plate 88 of first brake assembly 70 and combination brake lining 98/brake plate 100 of second brake assembly 72 is fully immersed in oil by suitably forming and arranging the illustrated flywheel bearing assembly 58 such that fluid communication is established between bearing assembly 58 and first and second brake housing areas 74 and 76, respectively. As shown, for example, the axial extent of bearing drain area 62 overlaps with an axial dimension of first brake housing area 74 proximate the lower end of the integral brake lining 86 and brake plate 88. Accordingly, brake housing area 74 is disposed in fluid communication with flywheel bearing assembly 58 at bearing drain area 62 such that fluid admitted into bearing drain area 62 may flow to brake housing area 74 for preferably immersing at least brake lining 86. Bearing drain area 62 is supplied with fluid exiting bearing 60. Oil which has had hydraulic contact with brake lining 86 and brake plate 88 passes by centrifugal force to drain line 106, formed in flywheel hub 52 to be conducted to second brake housing area 76 so as to be drained away at a location (not shown) to the press sump (not shown). Oil which has had hydraulic contact with brake lining 98 and brake plate 100 similarly passes into second brake housing area 76 to be drained away in the same manner.

Although, as depicted in the drawings, the oil for immersing the brake components is drawn from the hydrostatic/hydrodynamic bearing pads, this should not be considered in limitation of the present invention as it is possible for other suitable arrangements such as hydrodynamic-only bushings or anti-friction-type ball or roller bearings to likewise convey fluid to the brake housing areas. Additionally, other bearing pad arrangements may be used, most notably the pad arrangement disclosed in the aforementioned U.S. Pat. No. 5,556,207 in which the bearing pads are formed in the quill and open towards the flywheel bronze bushing disposed thereabout with a clearance therebetween. With such a quill configuration implemented as part of the flywheel bearing assembly 58, fluid communication could be established between the quill-formed bearing pads and the brake housing areas via suitable formation of the running clearance, which is sustained by the continuously present lubricating oil film existing between the pads and bushing.

Relative-motion-type seals 108 and 110 are provided in attachment to flywheel hub 52. Any oil escaping past these seals 108 and 110 may be collected and recovered through the use of a vacuum drain passage 112 provided in flywheel hub 52 in the illustrated manner, in which its outboard end lies proximate a cover plate 114 that conventionally forms an end piece for the press machine rotary assembly. Such a fluid control system is disclosed in U.S. Pat. No. 5,628,248, which is assigned to the same assignee as the instant application and is hereby incorporated by reference herein.

A hydraulic pump that generates a high-pressure fluid flow and which operates independently of the power source for the mechanical press is preferably coupled to inlet 94 of fluid supply line 92. This operational independence allows the brake linings 86 and 98 to be clamped to flywheel 50 even in the event that the main power to the mechanical press is interrupted.

Figure 5:
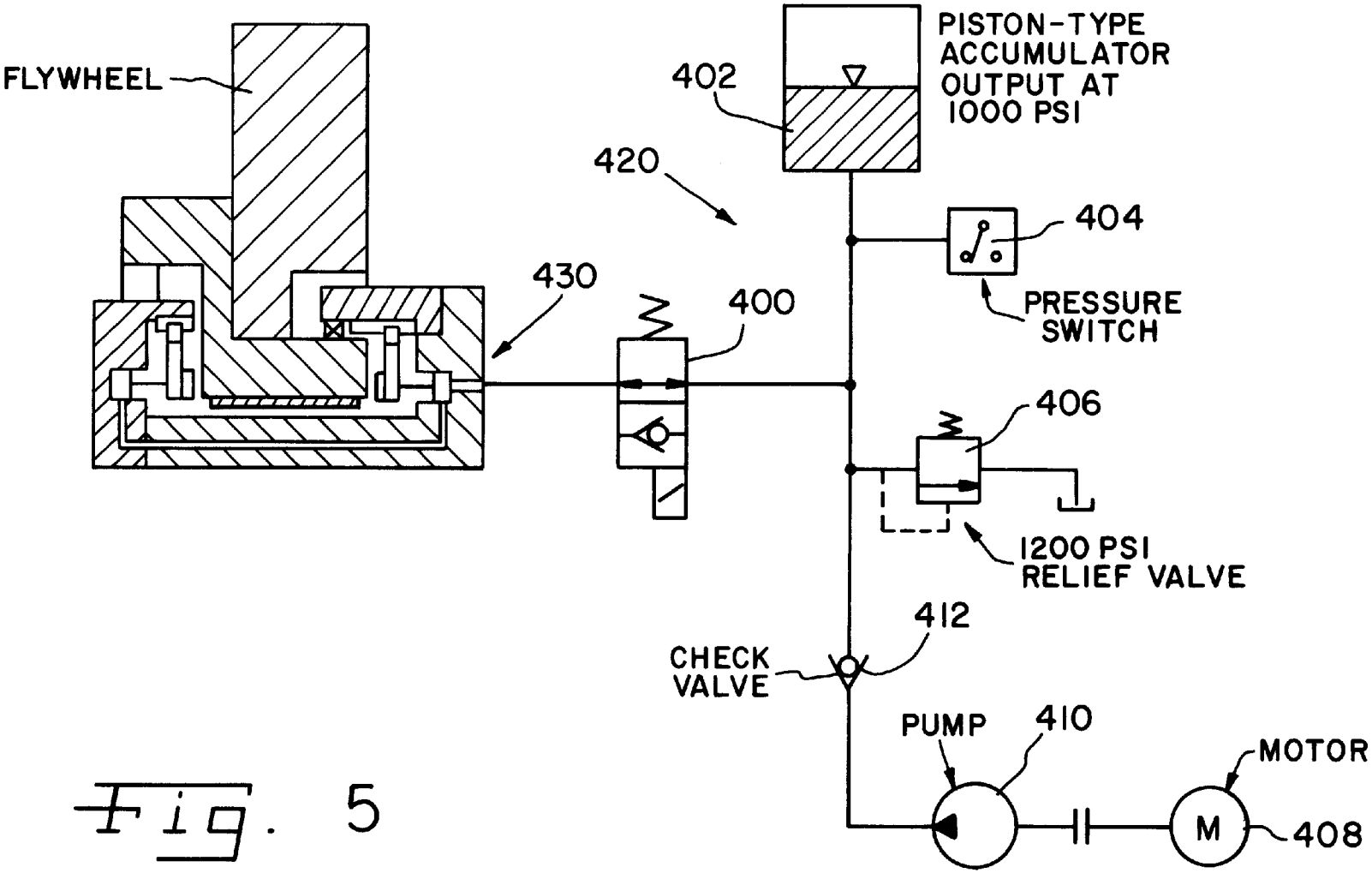
FIG. 5 is a block diagram illustration of a hydraulic circuit according to one embodiment of the present invention.

FIG. 5 illustrates an example hydraulic circuit for use with the wet-type flywheel brake. Piston-type accumulator 402 maintains an output of preferably 1000 psi. Pressure switch 404 provides an indication that the hydraulic circuit is pressurized and the press may be operated. Relief valve 406 is provided and preferably provides pressure relief when a pressure greater than or equal to 1200 psi is achieved in the hydraulic circuit. Valve 412 allows pump 410 to provide additional fluid pressure to hydraulic circuit 420. Motor 408 operates pump 410. Valve 400 is provided and allows hydraulic pressure to be introduced to the braking system 430.

According to the present invention there is disclosed a flywheel brake system that features the formation of respective brake housing areas in a quill assembly for containing the inboard and outboard brake assemblies each disposed in adjacent facing opposition with respect to a respective side surface of the flywheel hub. Hydraulic fluid is provided to these brake housing areas, preferably by way of suitable modifications/adaptations to the flywheel bearing system, in order to immerse the brake linings so as to achieve a measure of heat transfer and lubrication not otherwise available in conventional apparatus. This brake system provides a wet-type brake design that remains fully and continuously lubricated so as to provide an ongoing level of heat transfer that moves thermal energy away from the brake linings and brake plates, particularly during a braking operation when heat buildup occurs rapidly due to the contact-type frictional energy that is produced. The reduction of heat buildup and the lubrication combine to reduce friction lining wear to a minimum thus greatly extending flywheel brake facing life.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mechanical press, comprising:

a frame structure with a crown and a bed;

a slide guided by the frame structure for reciprocating movement in opposed relation to said bed;

a drive mechanism attached to said frame structure;

a quill assembly having a quill non-rotationally connected to said press;

a flywheel assembly rotatably driven by said drive mechanism, said flywheel assembly including a flywheel rotatable relative to said frame structure and axially mounted to said quill;

a crankshaft rotatably disposed within said crown and in driving connection with said slide, said crankshaft selectively connectable with said flywheel for driving rotation thereby;

said quill including a first recess formed therein and disposed adjacent said flywheel at one side thereof, said first quill recess defining a first chamber;

said quill further including a second recess formed therein and disposed adjacent said flywheel at another side thereof, said second quill recess defining a second chamber; and a brake system operatively associated with said flywheel, said brake system comprising:

a first brake assembly, disposed at least in part within said first quill recess, for selectively applying a braking action to said flywheel, and a second brake assembly, disposed at least in part within said second quill recess, for selectively applying a braking action to said flywheel.

2. The mechanical press as recited in claim 1, further comprises:

means for supplying fluid into at least one of said first quill recess and said second quill recess to enable hydraulic contact with said respective brake assembly disposed therein.

3. The mechanical press as recited in claim 1, wherein each one of said first brake assembly and said second brake assembly further comprises:

a respective flywheel engaging member arranged in facing relationship with said flywheel at the respective side thereof; and an associated hydraulic piston means for selectively reversibly moving said flywheel engaging member into braking engagement with said flywheel in response to the hydraulic activation of said hydraulic piston means.

4. A mechanical press as recited in claim 3, further comprises:

a hydraulic circuit for actuating said hydraulic piston means.

5. A mechanical press as recited in claim 3, wherein said hydraulic circuit further comprises:

an accumulator;

a pressure switch operatively connected to said accumulator;

a relief valve operatively connected to said accumulator;

a check valve operatively connected to said accumulator;

a pump;

a motor for actuating said pump, said motor operatively connected to said pump; and a second valve for allowing pressure to be supplied to said hydraulic piston means, said second valve operatively connected to said accumulator, said pump, said relief valve and said pressure switch.

6. A mechanical press as recited in claim 3, wherein said first brake assembly is a multiple disk brake assembly.

7. The mechanical press as recited in claim 3, further comprises:

means for supplying fluid to at least one of said first quill recess and said second quill recess to enable hydraulic contact with at least said flywheel engaging member associated therewith.

8. The mechanical press as recited in claim 3, further comprises:

a flywheel bearing supporting said flywheel assembly, said flywheel bearing including at least one bearing assembly disposed between said quill and said flywheel.

9. The mechanical press as recited in claim 8, wherein said at least one bearing assembly comprising a hydrostatic bearing pad means arranged, at least in part, for fluid communication with each one of said first quill recess and said second quill recess to enable hydraulic contact with at least said flywheel engaging member associated therewith.

10. The mechanical press as recited in claim 8, further comprises:

means for providing pressurized fluid to said hydrostatic bearing pad means.

11. The mechanical press as recited in claim 8, wherein said hydrostatic bearing pad means comprises:

a plurality of hydrostatic bearing pads formed in said quill and disposed in opposing facing relationship to a bushing connected to said flywheel and annularly disposed about said quill;

wherein a clearance space defined between said plurality of hydrostatic bearing pads and said bushing is arranged for fluid communication with each one of said first quill recess and said second quill recess.

12. The mechanical press as recited in claim 3, further comprises:

first means for providing pressurized hydraulic fluid to the respective hydraulic piston means associated with each one of said first brake assembly and said second brake assembly.

13. The mechanical press as recited in claim 12, wherein said first means further comprises:

a pump for supplying a pressurized fluid flow; and a fluid channel formed in said quill and adapted for coupling to said pump, said fluid channel being arranged at one section thereof for fluid communication with said first quill recess and being arranged at another section thereof for fluid communication with said second quill recess.

14. The mechanical press as recited in claim 13, wherein the respective hydraulic piston means associated with each one of said first brake assembly and said second brake assembly further comprises:

an annular seal member;

said annular seal member defining with said quill an associated hydraulic pressurization chamber arranged for fluid communication with said pump via said fluid channel.

15. The mechanical press as recited in claim 14, further comprises:

means, including a flywheel bearing assembly supporting said flywheel assembly, for providing fluid into at least one of said first quill recess and said second quill recess to enable hydraulic contact with at least said flywheel engaging member associated therewith.

16. A mechanical press, comprising:

a frame structure with a crown and a bed;

a slide guided by the frame structure for reciprocating movement in opposed relation to said bed;

a drive mechanism attached to said frame structure;

a quill assembly having a quill non-rotationally connected to said press;

a flywheel assembly rotatably driven by said drive mechanism, said flywheel assembly including a flywheel rotatable relative to said frame structure and axially mounted to said quill;

a crankshaft rotatably disposed within said crown and in driving connection with said slide, said crankshaft selectively connectable with said flywheel for driving rotation thereby;

said quill including a first recess formed therein and disposed adjacent said flywheel at one side thereof, said first quill recess defining a first chamber;

said quill further including a second recess formed therein and disposed adjacent said flywheel at another side thereof, said second quill recess defining a second chamber;

a brake assembly for selectively applying a braking action to said flywheel, said brake assembly comprising:

a first braking arrangement disposed, at least in part, within said first quill recess and comprising a respective flywheel engaging member arranged in facing relationship with said flywheel at the one side thereof and further comprising a respective hydraulic piston means for selectively reversibly moving the flywheel engaging member associated therewith into braking engagement with said flywheel in response to the hydraulic activation thereof, and a second braking arrangement disposed, at least in part, within said second quill recess and comprising a respective flywheel engaging member arranged in facing relationship with said flywheel at the another side thereof and further comprising a respective hydraulic piston means for selectively reversibly moving the flywheel engaging member associated therewith into braking engagement with said flywheel in response to the hydraulic activation thereof; and means for supplying fluid into at least one of said first quill recess and said second quill recess to enable hydraulic contact with at least said flywheel engaging member associated therewith.

17. The mechanical press as recited in claim 16, wherein said fluid supply means further comprises:

at least one bearing assembly disposed between said quill and said flywheel, said at least one bearing assembly arranged, at least in part, for fluid communication with each one of said first quill recess and said second quill recess; and means for providing pressurized fluid to said at least one bearing assembly.

18. The mechanical press as recited in claim 17, wherein said at least one bearing assembly comprises:

a plurality of hydrostatic bearing pads formed in said quill and disposed in opposing facing relationship to a bushing connected to said flywheel and annularly disposed about said quill;

wherein a clearance space defined between said plurality of hydrostatic bearing pads and said bushing is arranged for fluid communication with each one of said first quill recess and said second quill recess.

19. The mechanical press as recited in claim 16, further comprises:

first means for providing pressurized hydraulic fluid to the respective hydraulic piston means associated with at least one of said first braking arrangement and said second braking arrangement.

20. The mechanical press as recited in claim 19, wherein said first means further comprises:

a pump for supplying a pressurized fluid flow; and a fluid channel formed in said quill and adapted for coupling to said pump, said fluid channel being arranged at one section thereof for fluid communication with said first quill recess and being arranged at another section thereof for fluid communication with said second quill recess.

21. The mechanical press as recited in claim 20, wherein the respective hydraulic piston means associated with each one of said first braking arrangement and said second braking arrangement further comprises:

an annular seal member;

said annular seal member defining with said quill an associated pressurization chamber arranged for fluid communication with said pump via said fluid channel.

22. The mechanical press as recited in claim 21, wherein said fluid supply means further comprises:

means, including a flywheel bearing assembly supporting said flywheel assembly, for providing fluid into at least one of said first quill recess and said second quill recess to enable hydraulic contact with at least said flywheel engaging member associated therewith.

* * * * *